United States Patent [19]

Murakami et al.

[11] 4,292,096

[45] Sep. 29, 1981

[54] PHOSPHATING PROCESS OF METAL SURFACE

[75] Inventors: Ryoichi Murakami; Hideo Shimizu; Takashi Yoshii; Minoru Ishida; Hiroto Yonekura, all of Ikedanakamachi, Japan

[73] Assignee: Nippon Paint Co., Ltd., Osaka, Japan

[21] Appl. No.: 121,168

[22] Filed: Feb. 13, 1980

[30] Foreign Application Priority Data

Feb. 13, 1979 [JP] Japan ..... 54-15839

[51] Int. Cl.[3] ..... C23F 7/08

[52] U.S. Cl. ..... 148/6.15 Z; 204/181 C

[58] Field of Search ..... 148/6.15 Z, 6.15 R; 204/181 C; 118/304

[56] References Cited

U.S. PATENT DOCUMENTS 3,597,283 8/1971 Snee ..... 148/6.15 Z
3,676,224 7/1972 Snee ..... 148/6.15 Z
3,705,817 12/1972 Durr ..... 427/327
3,954,588 5/1976 Hazan et al. ..... 204/181 C
4,053,328 10/1977 Oka et al. ..... 148/6.15 Z
4,093,594 6/1978 Anderson ..... 204/181 C

FOREIGN PATENT DOCUMENTS 2232067 1/1973 Fed. Rep. of Germany ..... 148/6.15 Z

*Primary Examiner*—Ralph S. Kendall
*Attorney, Agent, or Firm*—Wenderoth, Lind & Ponack

[57] ABSTRACT

A process for phosphating a metal surface to be electrocoated, which comprises treating the metal surface with an acidic phosphating solution comprising a zinc compound in a concentration of 0.5 to 1.5 g/l as zinc ion, a phosphate in a concentration of 5 to 30 g/l as phosphate ion and a nitrite in a concentration of 0.01 to 0.2 g/l as nitrite ion and/or an aromatic nitro compound in a concentration of 0.05 to 2 g/l in water at a temperature of 40 to 70° C. first by dipping for not less than 15 seconds and then by spraying for not less than 2 seconds.

3 Claims, 28 Drawing Figures

PHOSPHATING PROCESS OF METAL SURFACE

The present invention relates to a phosphating process of a metal surface. More particularly, it relates to a process for phosphating the surface of a metallic substrate to make thereon a phosphate film excellent in adhesion and corrosion-resistance, which is particularly suitable as a base for cationic electrocoating.

The term "metal surface" is intended to mean the surface of any metallic substrate, particularly of a substrate of iron or steel, zinc or alloy thereof.

As the pre-treatment for electrocoating applicable before the top coating to articles like car bodies, automobile parts, steel furnitures, etc., there has hitherto been adopted phosphating (i.e. phosphate film formation treatment). For phosphating, the spray process is usually adopted in order to save the installation cost and improve the production efficiency. In case of the articles of complicated shapes which have many pocket portions, however, there are areas to which direct spray of a phosphating solution is not applicable. Such areas are drastically inferior in respect to corrosion-resistance, even after the subsequent electrocoating.

On the other hand, automobiles are exposed to various environmental conditions, and therefore their bodies are required to have a higher degree of corrosion-resistance including prevention of perforation on the lower parts and prevention of filiform corrosion on the outer plate portion.

In order to overcome the said drawback and meet the above requirement, the spray dip process has been developed recently. For example, Japanese Patent Publication (unexamined) No. 119435/1977 proposes a process wherein a metallic article to be phosphated is subjected to spraying with a phosphating solution for 5 to 30 seconds and then to dipping for 1 to 30 minutes. By this process, spraying produces an initial crystal of phosphate at the outer plate portion and dipping completes the formation of a phosphate film. At the pocket portion to which spraying is not applicable, a phosphate film is formed by dipping only. In such spray dip process, however, the pocket portion such as the inner plate portion of the side sill or the inner plate of the door receives repellent splashes of the phosphating solution or is exposed to an acidic atmosphere during spraying, which is effected for 5 to 30 seconds, and a blue color film (i.e. iron phosphate film) is formed within a short time and this film is no more converted even by dipping. This result with a blue color film and yellow rusts indicates incomplete and unfavorable phosphating. With regard to the outer plate portion, spraying for 5 to 30 seconds results in formation of an initial crystal so that, even by subsequent dipping, the crystals ultimately formed become leaf-like as produced through spraying only.

In case of construction materials, small parts, etc., phosphating is usually carried out by dipping, for instance, in a phosphating solution containing a high concentration of zinc ion (2 to 4 g/l) at a high temperature (60° to 90° C.) for a long period of time (3 to 10 minutes). The formed film has a large film weight (3 to 5 $g/m^2$) and, because of poor adhesion, low corrosion resistance and inferior appearance, is not suitable as a base for electrocoating.

In recent years, electrocoating compositions to be used in the automobile manufacturing field have been changing from of anion type to of cation type so as to assure a satisfactory rust-proof effect even under various environmental conditions. Different from anionic electrocoating compositions, cationic electrocoating compositions form a coating film as the result of liberation of an alcohol blocking the crosslinking agent therein on baking, and therefore the coating film is greatly shrinked and a considerable force acts on the phosphate film provided thereunder. Thus, the phosphate film as a base for cationic electrocoating is required to have a sufficient strength tolerable to the said shrinkage. Also, the phosphate film is required to have excellent alkali-resistance, because cationic electrocoating renders alkaline around the treated article on application of an electric current.

It has now been found that the performances of a phosphate film such as adhesion and corrosion resistance are much improved when the film is formed by the use of a phosphating solution having a certain composition according to a certain specific treatment procedure. Advantageously, such film is quite suitable as a base for cationic electrocoating. This invention is based on the above finding.

According to this invention, a metal surface is first dipped in an acidic phosphating solution comprising a zinc compound in a concentration of 0.5 to 1.5 g/l as zinc ion and a phosphate in a concentration of 5 to 30 g/l as phosphate ion with at least either one of a nitrite in a concentration of 0.01 to 0.2 g/l as nitrite ion and an aromatic nitro compound of 0.05 to 2 g/l in water at a temperature of 40° to 70° C. for not less than 15 seconds, and then sprayed with the same phosphating solution as above at the same temperature as above for 2 to 60 seconds. By such treatment, a uniform and fine phosphate film of low film weight (e.g. 1.5 to 3 $g/m^2$), especially having good adhesion and corrosion resistance suitable as a base for cationic electrocoating, is formed on the metal surface.

Prior to application of the phosphating treatment of the invention, a metallic article to be phosphated is usually cleaned. Such cleaning is effected, for instance, by treatment of the article with an alkaline degreasing agent (e.g. "RIDOLINE SD 200" manufactured by Nippon Paint Co., Ltd.) at a temperature of 50° to 60° C. for 2 minutes, followed by washing with water. Then, the article is treated with a surface conditioning agent (e.g., "FIXODINE 5N-5" manufactured by Nippon Paint Co., Ltd.) at a temperature of 50° to 60° C. for 10 to 30 seconds.

The thus cleaned article is, according to the invention, dipped in an acidic phosphating solution comprising a zinc compound in a concentration of 0.5 to 1.5 g/l as zinc ion, a phosphate in a concentration of 5 to 30 g/l as phosphate ion, a nitrite in a concentration of 0.01 to 0.2 g/l as nitrite ion and/or an aromatic nitro compound in a concentration of 0.05 to 2 g/l in water at a temperature of 40° to 70° C. for 15 to 120 seconds, and then it is sprayed with the same phosphating solution as above at the same temperature as above for not less than 2 seconds, usually followed by washing with tap water and deionized water in order.

The zinc ion which is the main component in the phosphating solution may be used in a concentration of 0.5 to 1.5 g/l, preferably of 0.7 to 1.2 g/l. When the concentration is lower than 0.5 g/l, a uniform phosphate film is not formed but an uneven, blue colored film is formed. When the concentration is higher than 1.5 g/l, a uniform phosphate film may be formed but the film is apt to be composed of leaf-like crystals as formed in the conventional spray process and is unsuitable as a base for cationic electrocoating. As the source for zinc ion, there may be employed zinc oxide, zinc carbonate, zinc nitrate, etc. The phosphate ion may be used in a concentration of 5 to 30 g/l, preferably of 10 to 20 g/l. When it is less than 5 g/l, the formed film is apt to become uneven. When it exceeds 30 g/l, there is not produced any higher effect. Examples of the source for phosphate ion are phosphoric acid, sodium phosphate, zinc phosphate, nickel phosphate, etc.

As the accelerator for phosphating, there may be used nitrite ion in a concentration of 0.01 to 0.2 g/l, preferably of 0.04 to 0.15 g/l, and/or an aromatic nitro compound in a concentration of 0.05 to 2 g/l, preferably of 0.1 to 1.5 g/l. If these accelerators are used in amounts of less than the said lower limits, sufficient phosphating cannot be attained and yellow rust or the like may be formed, and if the amounts exceed the upper limits, an uneven film of blue color tends to be formed. Examples of the nitrite ion source are sodium nitrite, ammonium nitrite, etc. As the aromatic nitro compound, there may be used m-nitrobenzenesulfonates (e.g. sodium m-nitrobenzenesulfonate), nitrobenzoic acid, nitroresorcinol, etc.

The phosphating solution may comprise nitrate ion, chlorate ion, nickel ion and cobalt ion in addition to the said zinc ion, phosphate ion, nitrite ion and an aromatic nitro compound. The concentrations of such optional components may be as follows: nitrate ion, 1 to 10 g/l, preferably 2 to 8 g/l; chlorate ion, 0.05 to 2 g/l, preferably 0.2 to 1.5 g/l; nickel ion, 0.05 to 2 g/l, preferably 0.2 to 1.5 g/l; cobalt ion, 0.05 to 2 g/l, preferably 0.1 to 1 g/l. These optional components may be contained solely or in combination of two or more. Preferred sources for them are nitric acid, sodium nitrate, ammonium nitrate, zinc nitrate, nickel nitrate, chloric acid, sodium chlorate, ammonium chlorate, nickel carbonate, nickel nitrate, nickel chloride, nickel phosphate, cobalt carbonate, cobalt nitrate, cobalt chloride, cobalt phosphate, etc.

The temperature at which treatment with the phosphating solution is effected may be from 40° to 70° C., preferably from 45° to 60° C. When the temperature is lower than 40° C., phosphating is not smoothly achieved, and a long time treatment is needed for formation of a satisfactory film. When the temperature exceeds 70° C., the composition of the phosphating solution is apt to be unbalanced due to decomposition of the accelerator and precipitation of the components so that a satisfactory film is not obtainable.

With regard to the treating time, firstly dipping may be made for 15 to 120 seconds, and then spraying for 2 to 60 seconds. Preferably, dipping may be made for 30 to 90 seconds, followed by spraying for 5 to 45 seconds. When the dipping time is less than 15 seconds, favorable cubic crystals are not obtainable, and unfavorable leaf-like crystals are rather formed. Even when the dipping time exceeds 120 seconds, any higher effect is not obtainable, and it results only in enlargement of the apparatus. In case of the spraying time being less than 2 seconds, the sludge deposited during dipping is not washed off but is firmly attached on the surface of the treated article. Thus, it is hardly eliminated at the step of washing with water, and the adhesion and appearance of the electrocoating film provided thereafter are deteriorated. When the spraying time exceeds 60 seconds, any higher effect is not produced, and only enlargement of the apparatus is resulted.

According to the present invention, it is possible to give a great improvement to the corrosion resistance inside the pocket portions (e.g. inside of the side sill, inside of the door, etc.) to which phosphating is hardly applicable under the conventional spray or spray dip process. Also, it produces a great improvement in the adhesion and corrosion resistance of the outer plate portions (e.g. fender, hood, roof, door, etc.). Moveover, it can afford a base suitable for the application of cationic electrocoating thereon. More surprisingly, according to the invention, phosphating films are formed inside the pockets and the like more than the conventional spray or spray dip process so that the treating area is increased for the same article; nevertheless, the etching amount on phosphating is $\frac{1}{2}$ to $\frac{2}{3}$ that of the conventional spray or spray dip process, and the amount of the chemicals to be used and the amount of the sludge produced are lessened to $\frac{2}{3}$ to $\frac{3}{4}$.

In summary, the present invention can provide the following advantages:

(1) It makes possible to phosphate the inside of the pocket portion which is hardly phosphated by the conventional spray or spray dip process.

(2) It is possible to improve to a great degree adhesion and corrosion resistance of the outer plate portion.

(3) It is suitable as a pre-treatment to the application of cationic electrocoating.

(4) It is possible to reduce drastically the amount of the chemicals to be used.

(5) It is possible to reduce greatly the production of the sludge.

IN THE DRAWINGS

The present invention will be illustrated more in detail by the following Examples and Comparative Examples.

Figure 1:
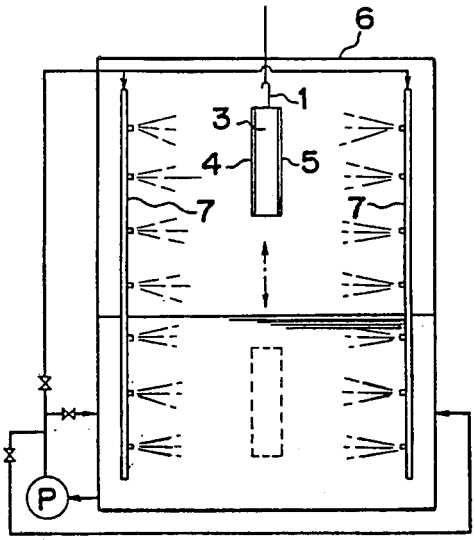
FIG. 1 is a schematic view of the vertical section of the coating apparatus.
Figure 2:
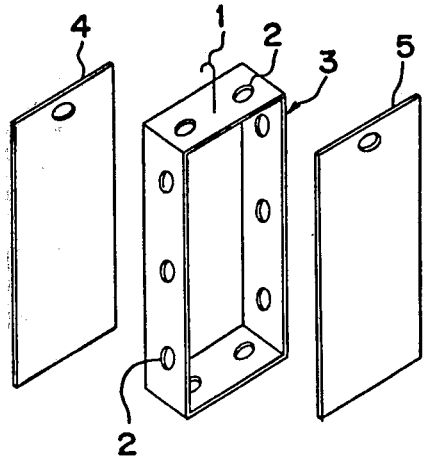
FIG. 2 is an enlarged prespective view of the frame type hanger and test plates as shown in FIG. 1.
Figure 1A:
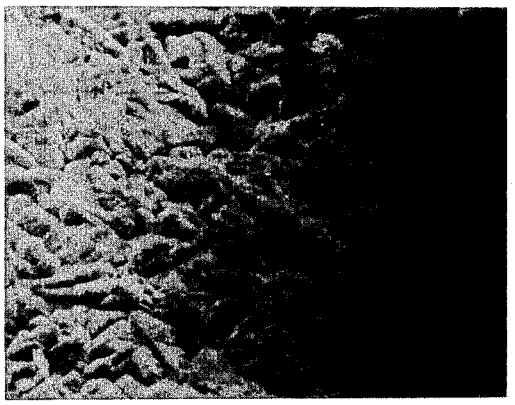
Figure 2A:
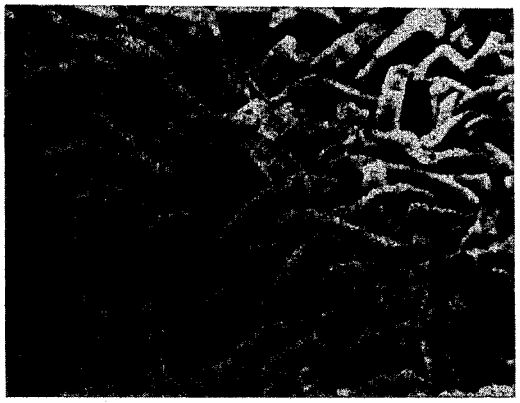
Figure 1B:
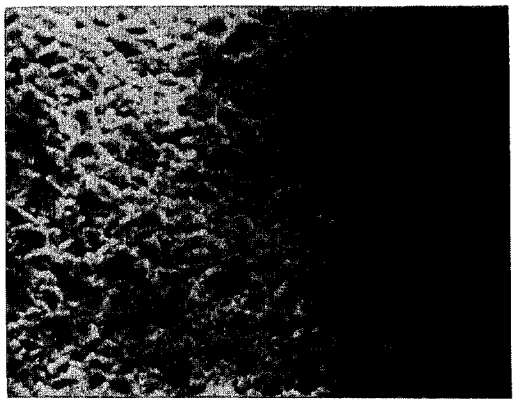
Figure 2B:
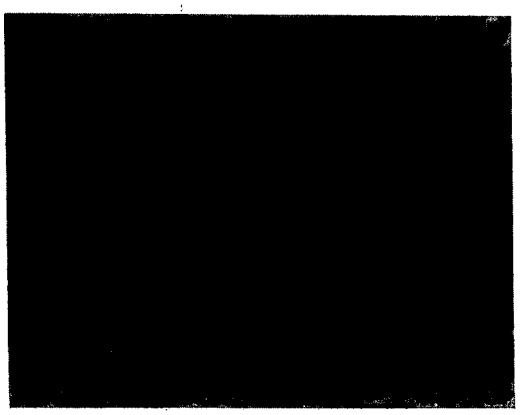
Figure 3A:
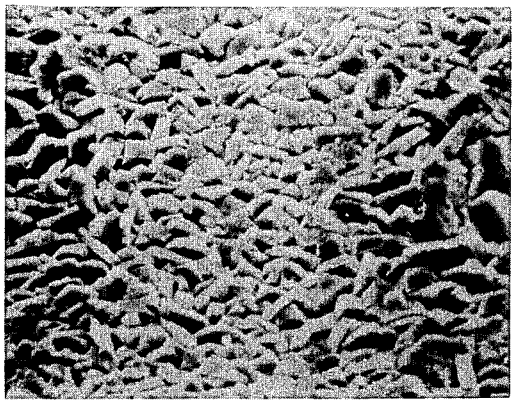
FIGS. 3A–13B are photographs taken on a scanning type electron microscope corresponding to the Examples.
Figure 4A:
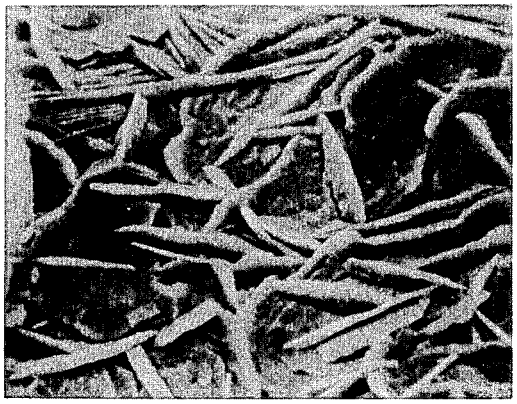
Figure 3B:
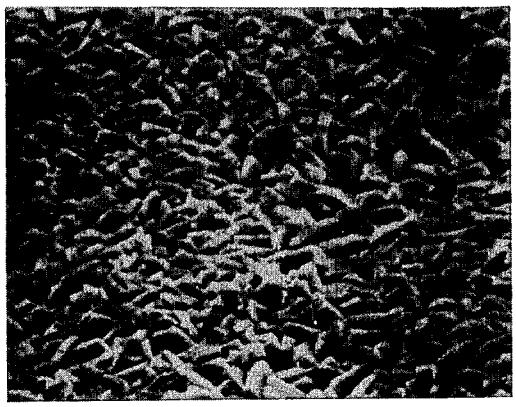
Figure 4B:
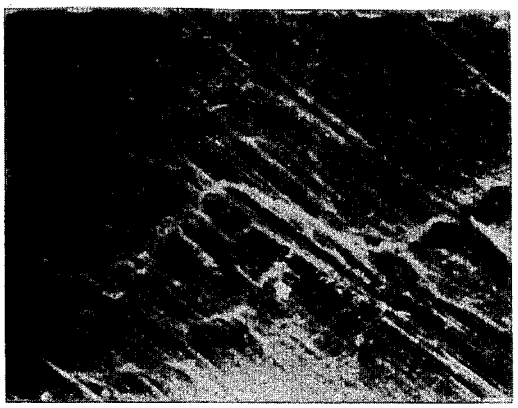
Figure 5A:
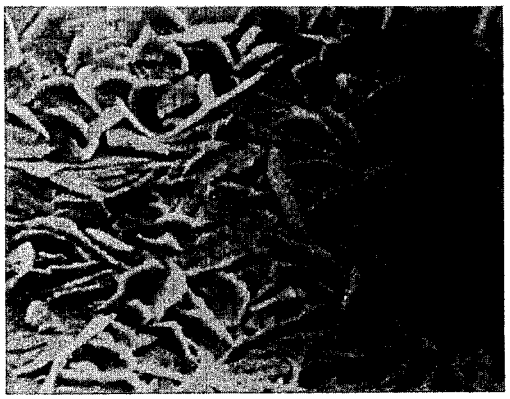
Figure 6A:
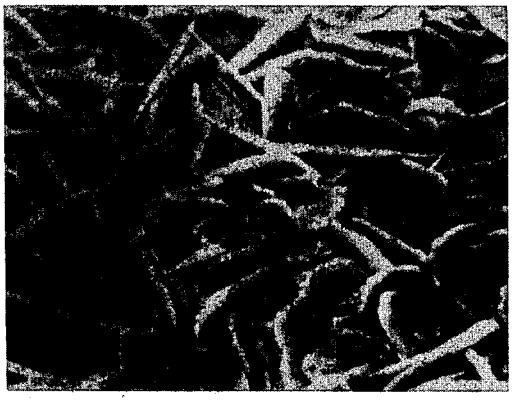
Figure 5B:
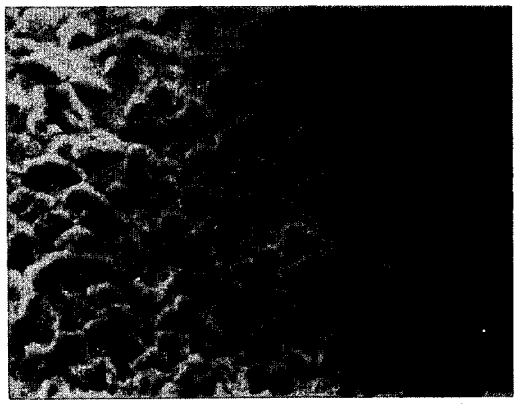
Figure 6B:
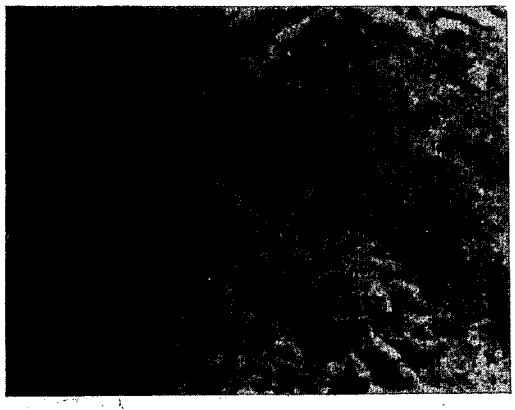
Figure 7A:
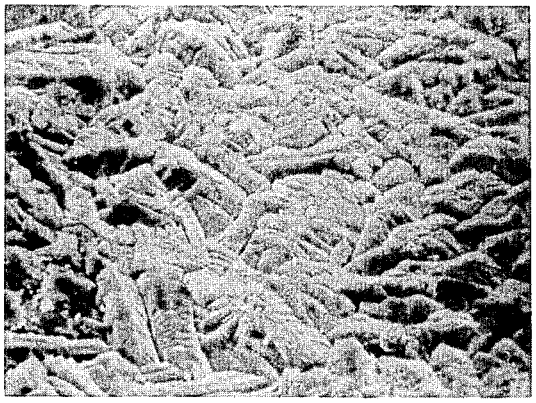
Figure 8A:
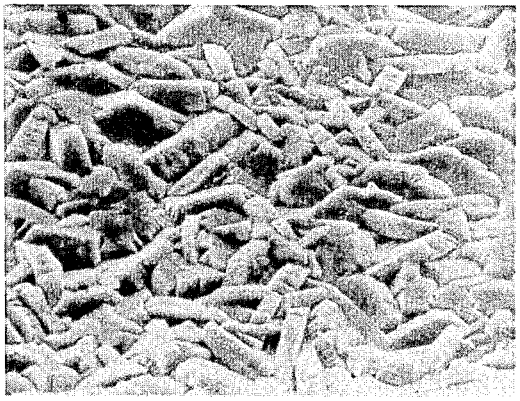
Figure 7B:
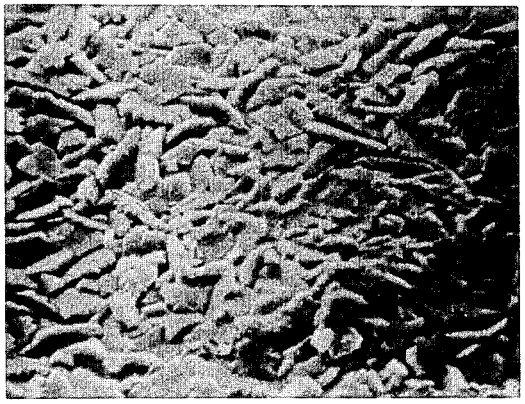
Figure 8B:
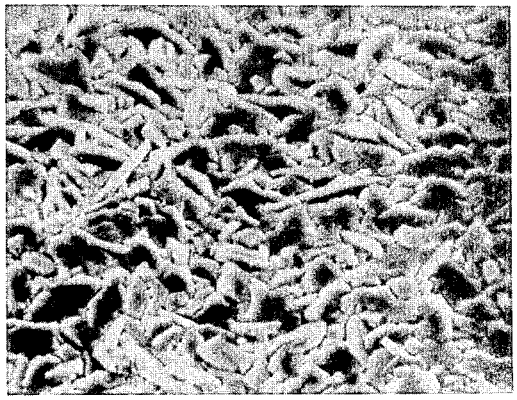
Figure 9A:
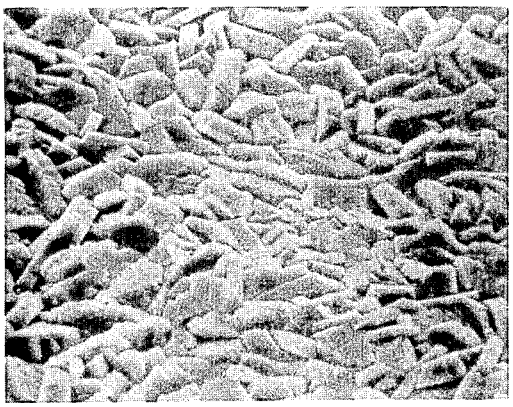
Figure 10A:
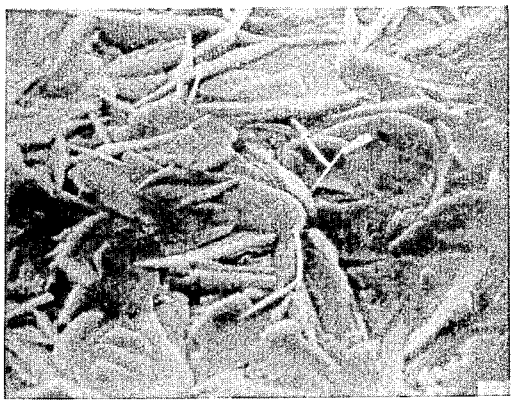
Figure 9B:
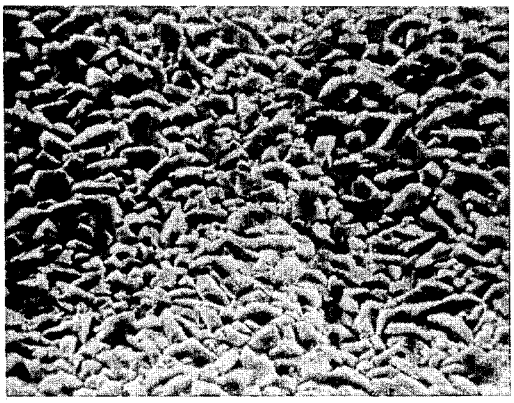
Figure 10B:
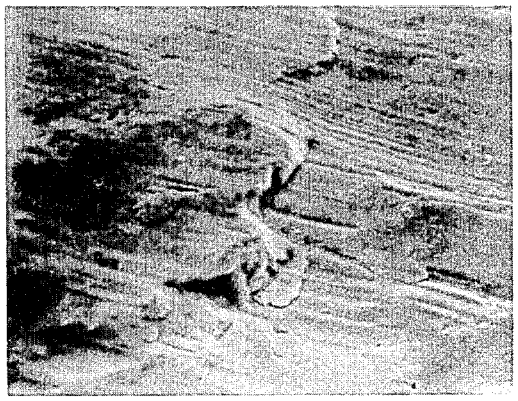
Figure 11A:
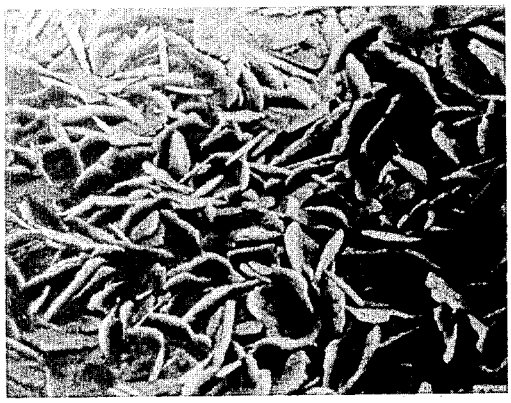
Figure 12A:
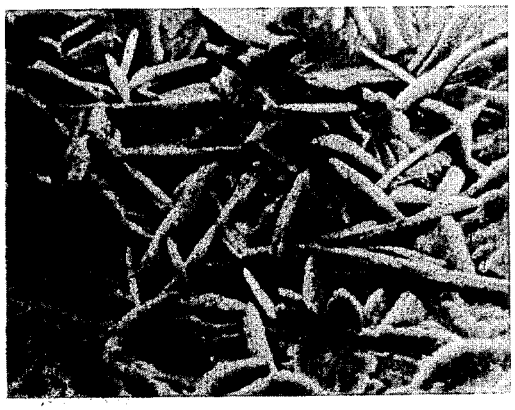
Figure 11B:
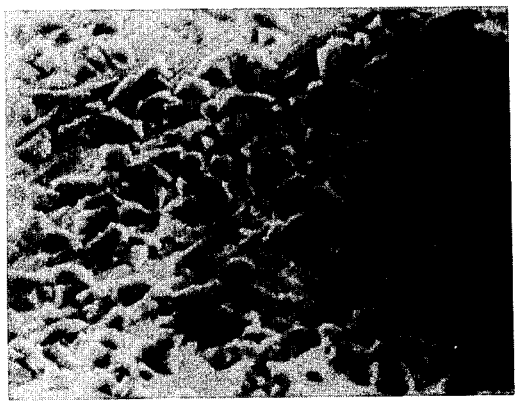
Figure 12B:
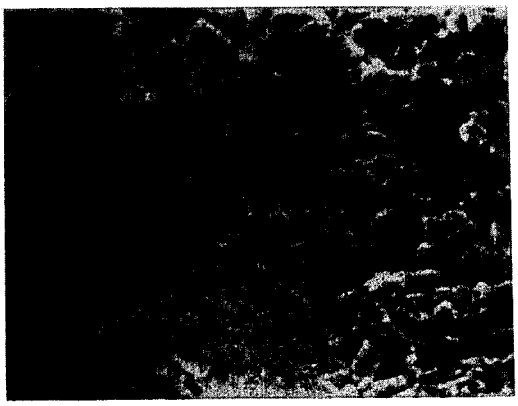
Figure 13A:
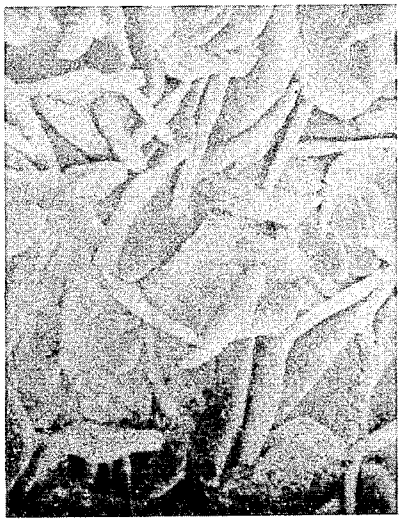
Figure 13B:
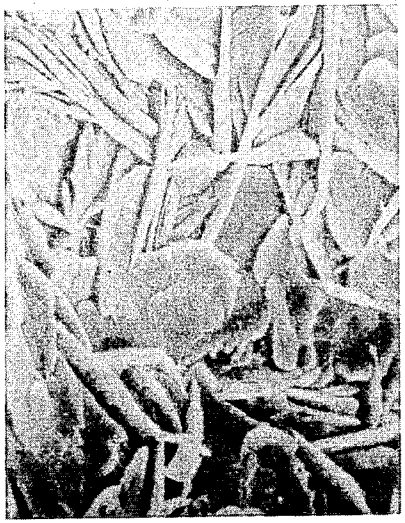

The apparatus for phosphating used in those Examples is shown in the accompanying drawings wherein FIG. 1 represents a schematic view of the vertical section of such apparatus and FIG. 2 is an enlarged perspective view of the frame type hanger and the test plates as shown in FIG. 1, each of the hanger and the plates being separated. In these Figures, a frame type hanger 3 has a hook 1 on the upper surface and plural holes 2 on the peripheral surfaces. The two open sides of the hanger are fixed with test plates 4, 5. The hanger 3 thus furnished with the test plates 4, 5 is suspended in the tank 6 which contains a phosphating solution. In case of spray treatment, the phosphating solution is sprayed to the test plates 4, 5 from the risers 7, 8 located within the tank. In case of dip treatment, the hanger 3 with the test plates 4, 5 is dipped in the phosphating solution.

EXAMPLES 1 TO 3

Commercialized cold rolled steel plates (70×150×0.8 mm) were treated with an alkali degreasing agent ("RIDOLINE SD 200", 2% by weight) at 60° C. by spraying for 1 minute, followed by dipping for 2 minutes. The plates were then washed with water and dipped in a surface conditioning agent ("FIXODINE,"

0.1% by weight) for 15 seconds. Thereafter, they were subjected to dip treatment in a phosphating solution containing 0.8 g/l of Zn ion, 0.5 g/l of Ni ion, 14 g/l of $PO_4$ ion, 3 g/l of $NO_3$ ion, 0.5 g/l of $ClO_3$ ion and 0.08 g/l of $NO_2$ ion under the conditions of a total acidity of 17 points, a free acidity of 0.9 point and a tonar value of 1.5 point at a temperature of 52° C. for 30 to 90 seconds, followed by spray treatment under the same conditions as above for 10 to 60 seconds. Thereafter, the plates were washed with tap water and deionized water in order and dried.

On the plates phosphated as above, the appearance of the film, the film amount and the film cry tal were inspected with the inner surface (the surface facing the inside of the hanger) and the outer surface (the surface opposite to the inner surface). The results are shown in Table 1 wherein the photographs indicating the film crystals were taken on a scanning type electron microscope ("JSM-T20" made by Nippon Denshi Co.) at an angle of 45° and a magnification of 1:1500.

The above phosphated plate was coated with a cationic electrocoating composition ("POWER TOP U-30 Black" made by Nippon Paint Co., Ltd.) under application of an electric voltage of 250 V for 3 minutes to make a coating film having a thickness of 20 microns and was baked at a temperature of 180° C. for 30 minutes.

The resulting electrocoated plate was subjected to 5% salt spray test (JIS (Japanese Industrial Standard) Z-2371) for 1000 hours. The results are shown in Table 1.

The above electrocoated plate was coated with an intermediate coating composition ("ORGA TO 778 Gray" manufactured by Nippon Paint Co., Ltd.) to make a coating film having a thickness of 30 microns, followed by baking. The resultant plate was then coated with a top coating composition ("ORGA TO 226 Margaret White" manufactured by Nippon Paint Co., Ltd.) to make a coating film having a thickness of 40 microns, followed by baking.

The thus obtained, 3 coated and 3 baked plate was dipped in deionized water at 50° C. for 10 days and cut into sections at intervals of 2 mm on both sides to make 100 squares in total. To the surface an adhesive tape was stuck, after which it was peeled off and the number of the squares remaining on the plate were counted to insepct adhesion.

Another 3-coated and 3-baked plate was installed at an inclination of 15 degrees to a horizontal plane. Onto this plate, a steel arrow of 1.00 g in weight and 140 mm in total length having a conical head (material quality: JIS G-4404; hardness, Hv more than 700) was dropped perpendicularly from a distance of 150 cm above the plate to make 25 flaws. Then, the plate was subjected to corrosion test (hereinafter referred to as "spot rust test") of 4 cycles, each cycle comprising salt spray test (JIS Z-2371) for 24 hours, wet test (temperature, 40° C.; relative humidity, 85%) for 120 hours and allowing to stand in a room for 24 hours. Survey was made on the mean values of the maximum sizes of filiform corrosion and blisters on the surface after the test. The results are shown in Table 1.

COMPARATIVE EXAMPLES 1 TO 3

Phosphating treatment and subsequent electrocoating and normal coatings were carried out in the same manner as adoped in Examples 1 to 3. However, in Comparative Example 1, phosphating treatment was made only by spraying for 2 minutes. In Comparative Example 2, phosphating treatment was made by spraying for 15 seconds and dipping for 2 minutes. In comparative Example 3, phosphating treatment was made by spraying for 30 seconds and dipping for 2 minutes. Performances of the produced films and coatings were tested in the same manner as in Examples 1 to 3. The results are shown in Table 1.

TABLE 1

| | Phosphating procedure | | Appearance of film: Outer surface | Appearance of film: Inner surface | Weight of film: Outer surface ($g/m^2$) | Weight of film: Inner surface ($g/m^2$) | Film Crystal: Outer surface | Film Crystal: Inner surface |
|---|---|---|---|---|---|---|---|---|
| Example 1 | Dipping<br>Spraying | 30 sec.<br>60 sec. | Even, fine, excellent film | | 2.1 | 2.0 | Photo. 1-a | Photo. 1-b |
| Example 2 | Dipping<br>Spraying | 60 sec.<br>30 sec. | Even, fine, excellent film | | 2.3 | 2.2 | Photo. 2-a | Photo. 2-b |
| Example 3 | Dipping<br>Spraying | 90 sec.<br>10 sec. | Even, fine, excellent film | | 2.3 | 2.3 | Photo. 3-a | Photo. 3-b |
| Comparative Example 1 | Spraying | 2 min. | Even, excellent film | Iron phosphate film with yellow rust | 2.5 | 0.3 | Photo. 4-a | Photo. 4-b |
| Comparative Example 2 | Spraying<br>Dipping | 15 sec.<br>2 min. | Even, excellent film | Uneven, zinc phosphate film | 2.4 | 1.4 | Photo. 5-a | Photo. 5-b |
| Comparative Example 3 | Spraying<br>Dipping | 30 sec.<br>2 min. | Even, excellent film | Blue colored iron phosphate film | 2.5 | 1.0 | Photo. 6-a | Photo. 6-b |

| | Salt Spraying: Outer surface | Salt Spraying: Inner surface | Adhesion: Outer surface | Adhesion: Inner surface | Spot rust test: Outer surface (mm) | Spot rust test: Inner surface (mm) |
|---|---|---|---|---|---|---|
| Example 1 | less | less | 100/100 | 100/100 | 0.95 | 1.1 |

TABLE 1-continued

| | | | | | | |
|---|---|---|---|---|---|---|
| | than 1 mm | than 1 mm | | | | |
| Example 2 | less than 1 mm | less than 1 mm | 100/100 | 100/100 | 0.94 | 0.91 |
| Example 3 | less than 1 mm | less than 1 mm | 100/100 | 100/100 | 0.90 | 0.90 |
| Comparative Example 1 | 4.0 mm | Tape width | 0/100 | 30/100 | 2.81 | 5.03 |
| Comparative Example 2 | 2.5 mm | 2 mm | 51/100 | 73/100 | 1.93 | 2.04 |
| Comparative Example 3 | 3 mm | 4 mm | 0/100 | 20/100 | 2.12 | 3.27 |

From Table 1 and Photographs 1 to 6, it is understood that according to the spray process and the spray dip process given in Comparative Examples 1 to 3, a uniform, satisfactory film is formed on the outer surface of the plate, but an uneven film containing yellow rust and/or blue colored iron phosphate is formed on the inner surface. Further, even the film formed on the outer surface is inferior in water resistant adhesion, resistance to salt spraying and performance against spot rust after cationic electrocoating. According to the present invention process, normal, fine and good films are formed on both the inner and outer surfaces, and water resistant adhesion, resistance to salt spray and performance against spot rust after cationic electrocoating are excellent.

EXAMPLES 4 TO 6

In the same manner as in Examples 1 to 3, commercialized cold rolled steel test plates (70×150×0.8 mm) were subjected to degreasing, water-washing and surface conditioning. Then, they were treated with a phosphating solution containing 1.2 g/l of Zn ion, 0.1 g/l of Co ion, 14 g/l of $PO_4$ ion, 0.3 g/l of $ClO_3$ ion, 5 g/l of $NO_3$ ion and 0.4 g/l of m-nitrobenzenesulfonic acid by dipping under the conditions of a total acidity of 17 points and a free acidity of 0.9 point at a temperature of 50° C. for 30 to 90 seconds, followed by spraying for 5 to 60 seconds. Thereafter, the plates were subjected to electrocoating and normal coating in the same manner as in Examples 1 to 3 and tested. The results are shown in Table 2.

COMPARATIVE EXAMPLES 4 TO 7

Phosphating treatment and subsequent electrocoating and normal coatings were carried out in the same manner as adopted in Examples 4 to 6. However, in Comparative Example 4, phosphating treatment was made only by spraying for 2 minutes. In Comparative Example 5, phosphating treatment was made by spraying for 10 seconds and dipping for 2 minutes. In Comparative Example 6, phosphating treatment was made by spraying for 30 seconds and dipping for 2 minutes. In Comparative Example 7, phosphating treatment was made by dipping in the same phosphating solution as above but containing zinc ion in a concentration of 2.0 g/l for 2 minutes and spraying for 5 seconds. Performances of the produced films and coating were tested in the same manner as in Examples 4 to 6. The results are shown in Table 2.

TABLE 2

| | Phosphating procedure | | Appearance of film: Outer surface | Appearance of film: Inner surface | Weight of film: Outer surface (g/m²) | Weight of film: Inner surface (g/m²) | Film crystal: Outer surface | Film crystal: Inner surface |
|---|---|---|---|---|---|---|---|---|
| Example 4 | Dipping<br>Spraying | 30 sec.<br>60 sec. | Even, fine, excellent film | | 2.0 | 1.8 | Photo. 7-a | Photo. 7-b |
| Example 5 | Dipping<br>Spraying | 60 sec.<br>30 sec. | Even, fine excellent film | | 2.1 | 2.1 | Photo. 8-a | Photo. 8-b |
| Example 6 | Dipping<br>Spraying | 90 sec.<br>5 sec. | Even, fine, excellent film | | 2.2 | 2.1 | Photo. 9-a | Photo. 9-b |
| Comparative Example 4 | Spraying | 2 min. | Even, excellent film | Iron phosphate film with yellow rust | 2.3 | 0.3 | Photo. 10-a | Photo. 10-b |
| Comparative Example 5 | Spraying<br>Dipping | 10 sec.<br>2 min. | Even, excellent film | Uneven, zinc phosphate film | 2.3 | 1.5 | Photo. 11-a | Photo. 11-b |
| Comparative Example 6 | Spraying<br>Dipping | 30 sec.<br>2 min. | Even, excellent film | Blue colored iron phosphate film | 2.4 | 0.9 | Photo. 12-a | Photo. 12-b |
| Comparative Example 7 | Dipping<br>Spraying | 2 min.<br>5 sec. | Even, excellent film | | 2.6 | 2.6 | Photo. 13-a | Photo. 13-b |

| | Salt spraying: Outer | Salt spraying: Inner | Adhesion: Outer | Adhesion: Inner | Spot rust test: Outer surface | Spot rust test: Inner surface |
|---|---|---|---|---|---|---|

TABLE 2-continued

| | surface | surface | surface | surface | (mm) | (mm) |
|---|---|---|---|---|---|---|
| Example 4 | less than 1 mm | less than 1 mm | 100/100 | 100/100 | 1.00 | 1.01 |
| Example 5 | less than 1 mm | less than 1 mm | 100/100 | 100/100 | 0.98 | 0.99 |
| Example 6 | less than 1 mm | less than 1 mm | 100/100 | 100/100 | 0.91 | 0.90 |
| Comparative Example 4 | 4.5 mm | Tape width | 0/100 | 35/100 | 3.07 | 4.91 |
| Comparative Example 5 | 2.0 mm | 2.5 mm | 40/100 | 65/100 | 2.11 | 2.37 |
| Comparative Example 6 | 4 mm | Tape width | 0/100 | 70/100 | 2.46 | 2.67 |
| Comparative Example 7 | 1.5 mm | 1.5 mm | 65/100 | 70/100 | 1.85 | 1.71 |

From Table 2 and Photographs 7 to 13, it is understood that according to the spray process and the spray dip process given in Comparative Examples 4 to 6, a uniform, excellent film is formed on the outer surface but an uneven film containing yellow rust and/or blue colored iron phosphate is formed on the inner surface. Also, according to the dip spray process given in Comparative Example 7 wherein the phosphating solution has a large concentration of zinc ion, uniform films are formed on both the inner and outer surfaces but the film crystals thereof become leaf-like as those formed on the outer surface in Comparative Examples 4 to 6, and yet water-resistant adhesion, resistance to salt spraying and performance against spot rust are unsatisfactory after cationic electrocoating. Further, Comparative Examples 4 to 6 show poor results after cationic electrocoating. In comparison with the above, when the present invention process is practised, both the outer and the inner surfaces are provided with even, fine and excellent films for a dipping time of 30, 60 or 90 seconds, and satisfactory results are obtained in water-resistant adhesion, resistance to salt spraying and performance against spot rust after cationic electrocoating.

What is claimed is:

1. In a process for forming an electrocoated film on the surface of a metal substrate by subjecting said metal surface to phosphating and then to cationic electrocoating, the improvement wherein the phosphating consists essentially of first dipping the metal surface into an acidic phosphating solution consisting essentially of a zinc compound in a concentration of 0.5 to 1.5 g/l as a zinc ion, a phosphate in a concentration of 5 to 30 g/l as a phosphate ion and a nitrite in a concentration of 0.01 to 0.2 g/l as a nitrite ion and/or an aromatic nitro compound in a concentration of 0.05 to 2 g/l in water and a chlorate in a concentration of 0.05 to 2 g/l as a chlorate ion, at a temperature of 40° to 70° C. for not less than 15 seconds and then spraying the metal surface with said acidic phosphate solution for not less than 2 seconds.

2. The process according to claim 1, wherein the acidic phosphating solution further comprises a nitrate in a concentration of 1 to 10 g/l as a nitrate ion.

3. The process according to claim 1 or 2, wherein the acidic phosphating solution further comprises a nickel compound in a concentration of 0.05 to 2 g/l as a nickel ion and/or a cobalt compound in a concentration of 0.05 to 2 g/l as a cobalt ion.

* * * * *